US006675881B1

(12) United States Patent
Rago

(10) Patent No.: US 6,675,881 B1
(45) Date of Patent: Jan. 13, 2004

(54) HEAT EXCHANGER WITH FINS FORMED FROM SLOTS

(75) Inventor: Gluseppe Rago, Mississauga (CA)

(73) Assignee: Pratt and Whitney Canada Corp., Longueil (CA)

( * ) Notice: Subject to any disclaimer, the term of this patent is extended or adjusted under 35 U.S.C. 154(b) by 0 days.

(21) Appl. No.: 10/289,279

(22) Filed: Nov. 7, 2002

(51) Int. Cl.[7] ..... F28D 7/10

(52) U.S. Cl. ..... 165/154; 165/133; 165/181; 138/38; 29/890.36

(58) Field of Search ..... 165/177, 181, 165/154, 133, 141, 140; 29/890.036, 890.037; 138/38, 114, 115, 116, 117

(56) References Cited

U.S. PATENT DOCUMENTS 1,983,466 A 12/1934 Kline
2,378,646 A * 6/1945 Manning ..... 29/890.036
2,386,746 A 10/1945 Hess
2,448,315 A * 8/1948 Kunzog ..... 165/119
3,493,041 A 2/1970 Hourwitz et al.
3,934,618 A 1/1976 Henderson
4,211,277 A * 7/1980 Grosz-Roll et al. ..... 165/109.1
4,351,391 A 9/1982 Eberhardt
4,368,777 A 1/1983 Grasso
5,145,001 A 9/1992 Valenzuela
6,003,559 A * 12/1999 Baker ..... 138/108
6,032,699 A * 3/2000 Cochran et al. ..... 138/104
6,098,704 A 8/2000 Tsuchiya et al.
6,157,778 A 12/2000 Kadotani
6,237,322 B1 5/2001 Rago

* cited by examiner

*Primary Examiner*—Terrell McKinnon
(74) *Attorney, Agent, or Firm*—Ogilvy Renault

(57) ABSTRACT

A method for forming a plurality of heat transfer fins on at least an inner surface of a conduit in a heat exchanger, the method comprising: forming a plurality of criss-crossing slots in at least a portion of the inner surface of the conduit, the plurality of slots defining the plurality of heat transfer fins therebetween.

17 Claims, 10 Drawing Sheets

HEAT EXCHANGER WITH FINS FORMED FROM SLOTS

TECHNICAL FIELD

The present invention relates generally to gas turbine engines, and more particularly to a heat transfer fin configuration formed in a conduit of a coaxial heat exchanger, and a method of creating the same.

BACKGROUND OF THE INVENTION

Both plate and cylindrical heat exchangers are well known and used in various applications, including gas turbine engines. The heat transfer performance advantages possible with plate heat exchangers are also well known, often resulting from a greater fin configuration flexibility and the ability to manufacture a flat plate with more densely packed fins than is generally possible with cylindrical type heat exchangers. However, in order to provide sufficient heat transfer, plate-fin type heat exchangers must be relatively large. In comparison, cylindrical heat exchangers are significantly more compact, and can offer considerable weight and part number reductions relative to flat plate heat exchangers. However, cylindrical heat exchangers often fail to provide performance equivalent to that of a corresponding plate heat exchanger.

Cylindrical heat exchangers are generally composed of at least two concentric pipes, each providing a path for a fluid to flow therethrough, such that a hotter fluid flowing through the first pipe can transfer heat to a cooler fluid flowing through the second pipe. To improve heat transfer, it is known to have fins, often longitudinally extending, projecting into both pipes from a common wall. Such an inner tube 10 of cylindrical heat exchanger is shown in FIG. 1. The pipe 10 generally has a plurality of longitudinally extending inner fins 12 projecting into the pipe and a plurality of longitudinally extending outer fins 13 extending outwards from the pipe. Longitudinally extending fins are often used because they are generally more straightforward to manufacture on cylindrical pipes.

As is well known in the art, the fins provide extended surfaces for augmenting heat transfer between a fluid within the pipe and a fluid flowing outside the pipe. These fins generally belong to a class of devices called "extended surfaces", as they expose more surface area of the pipe, thereby enhancing convective heat transfer. However, it is difficult to efficiently produce a large number of fins on the inner side of the pipe or tube dividing the two fluid flows. Consequently, the performance of small cylindrical heat exchangers suffers as a result of the reduced fin density. It has additionally proved difficult to create extended surfaces on the inner side of a cylindrical heat exchanger pipe that that are not longitudinally extending fins, and particularly to produce staggered pins. Fins have been fabricated in many ways, such as welding, casting, extruding, embedding, wrapped on, or machined from thick stock. However, none of these current methods easily permit the creation of pins or pedestal type fins, particularly staggered ones, on the inner surface of a cylindrical heat exchanger pipe. Both of these factors, namely a high density of fins and fins arranged in a staggered layout, are known to improve the heat transfer performance of a heat exchanger, but have to date been difficult to achieve within cylindrical heat exchanger pipes.

SUMMARY OF THE INVENTION

It is an object of the present invention to provide a improved heat exchanger.

It is another object of the present invention to provide a heat exchanger for a gas turbine engine that provides reduced cost, weight, and number of parts.

It is another object of the present invention to provide a cylindrical heat exchanger having improved performance.

It is a further object of the present invention to provide a cylindrical heat exchanger having staggered fins on an inner surface of a conduit thereof.

Therefore, in accordance with the present invention, there is provided a heat exchanger permitting heat transfer between a first and a second fluid conveyed therethrough, comprising: an inner conduit and an outer conduit, the inner conduit defining a first passage for conveying the first fluid therethrough, the inner conduit being inside the outer conduit, and the inner conduit and the outer conduit defining a second passage therebetween for conveying the second fluid therethrough; and at least the inner conduit having a plurality of slots in at least an inner surface thereof, the plurality of slots being provided at least partially in a crisscrossing arrangement, thereby defining a plurality of heat transfer fins on at least the inner surface of the inner conduit.

There is also provided, in accordance with the present invention, a method for forming a plurality of heat transfer fins on at least an inner surface of a conduit in a heat exchanger, the method comprising: forming a plurality of criss-crossing slots in at least a portion of the inner surface of the conduit, the plurality of slots defining the plurality of heat transfer fins therebetween.

There is further provided, in accordance with the present invention, a heat exchanger permitting heat transfer between a first and a second fluid conveyed therethrough, comprising: a first conduit and a second conduit, the first conduit being adapted for conveying the first fluid therein and the second conduit being adapted for conveying the second fluid therein; the first conduit and the second conduit being relatively arranged such that heat transfer between the first fluid and second fluid is permitted; and at least one of the first conduit and the second conduit having a plurality of slots in an inner surface thereof, the plurality of slots being disposed in a criss-crossing arrangement such that a plurality of heat transfer enhancing fins are provided therebetween.

BRIEF DESCRIPTION OF THE DRAWINGS

Further features and advantages of the present invention will become apparent from the following detailed description, taken in combination with the appended drawings, in which.

DETAILED DESCRIPTION OF THE PREFERRED EMBODIMENT

The cylindrical, and in this case concentric, heat exchanger assembly 50 is preferably adapted for use in a gas turbine engine as a fuel-oil heat exchanger. Conventional gas turbine engines generally include independent oil and fuel circuits, wherein the fuel circuit conducts fuel fed by a fuel pump from a fuel tank to the fuel nozzles in the combustion chamber, and the separate oil circuit circulates lubricating oil between bearings and other moving components and an oil tank, via an oil pump, an oil filter and a heat exchanger. Both the fuel and oil circuits are conveyed through the heat exchanger, such that the hot oil is cooled, and the cold fuel from the fuel tank is heated sufficiently to avoid icing of the fuel filter. The fuel is thereby additionally pre-heated prior to injection into the gas turbine combustion chamber.

Figure 1:
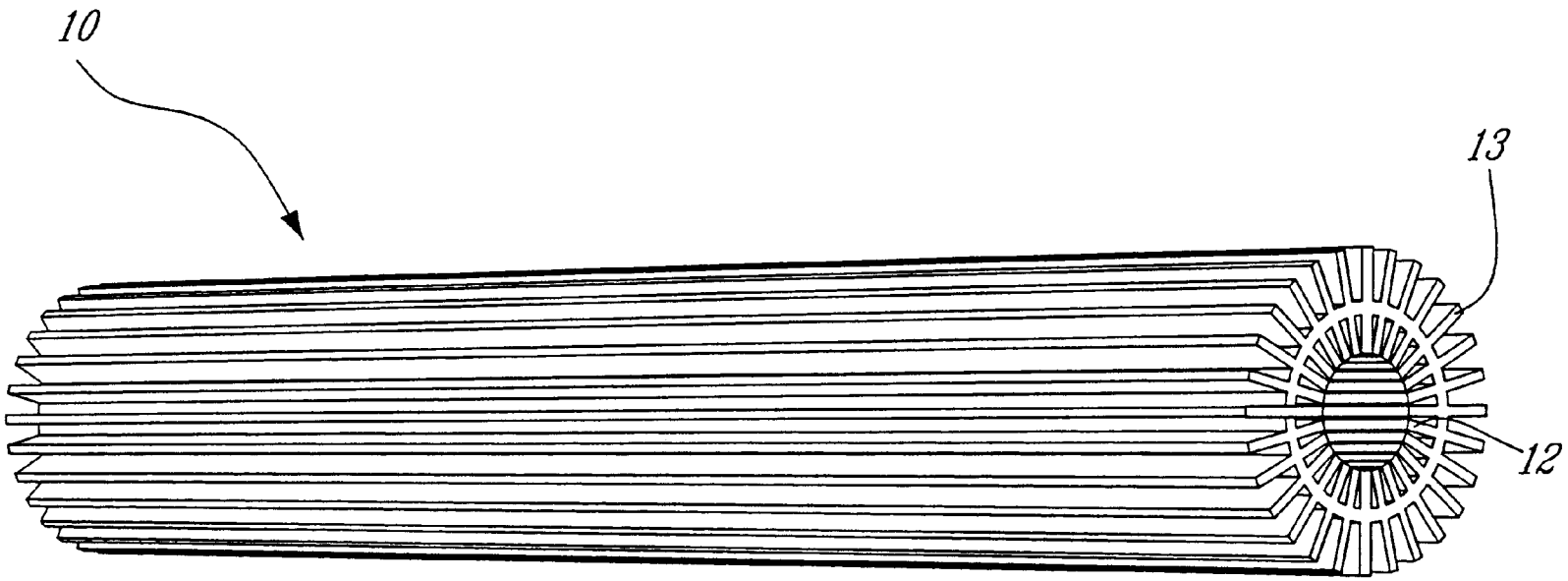
fig. 1 (PRIOR ART)
FIG. 1 is a perspective view of a finned heat exchanger tube of the prior art, for use in a cylindrical heat exchanger.
Figure 2A:
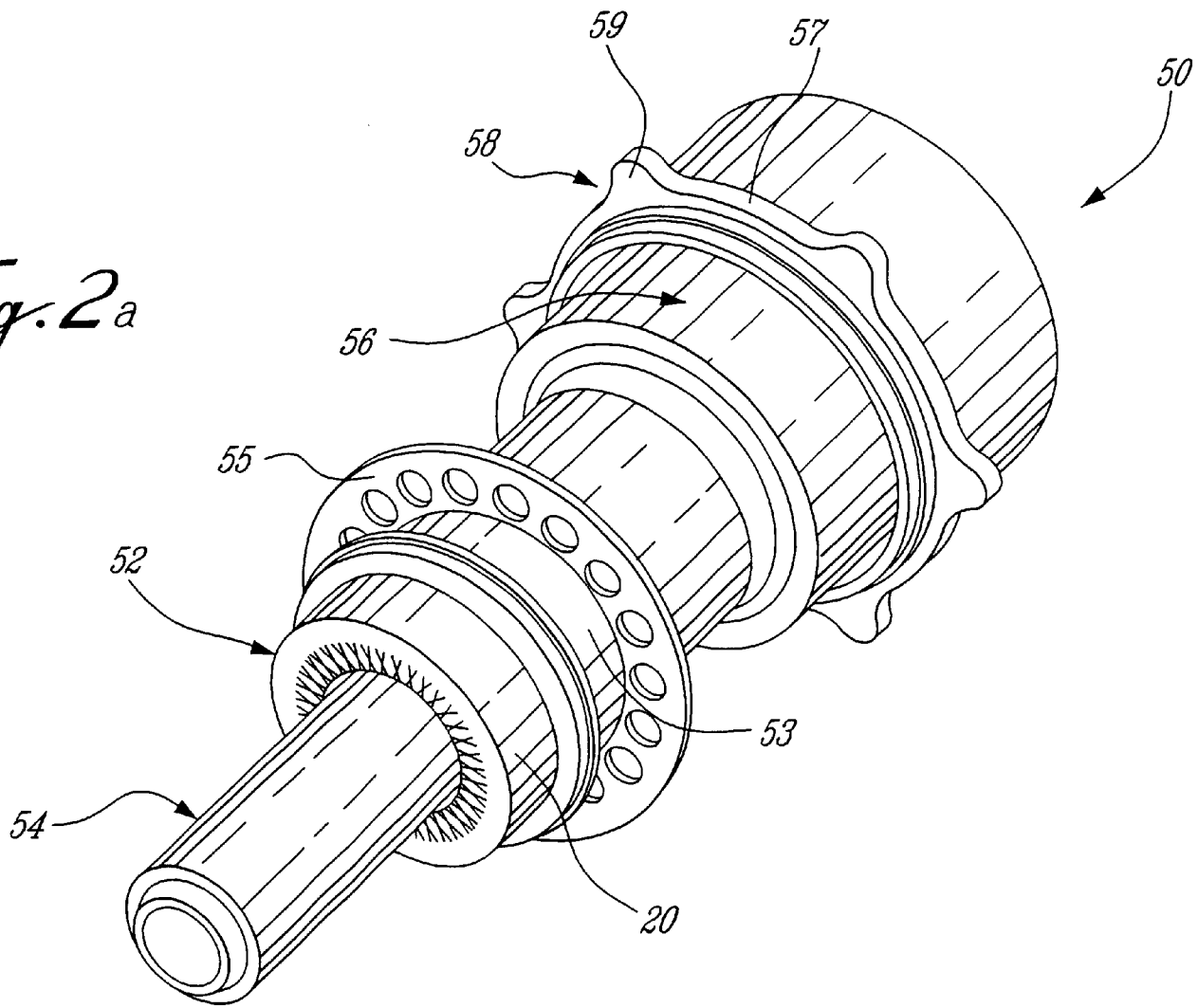
FIG. 2*a* is a perspective view of a cylindrical fuel-oil heat exchanger assembly of the present invention.
Figure 2B:
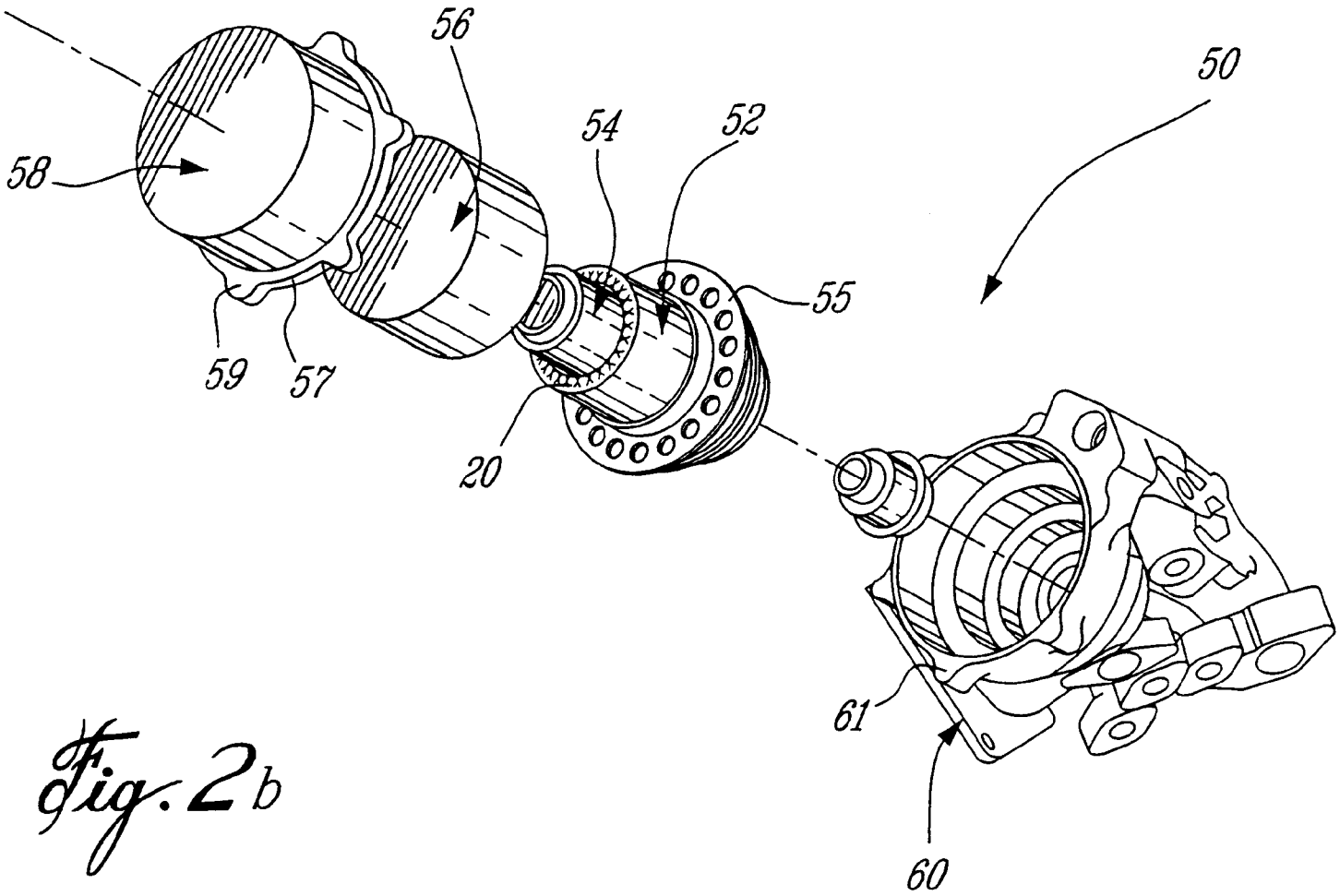
FIG. 2*b* is an exploded view of the fuel-oil heat exchanger assembly of FIG. 3 with a mating housing.

Referring to FIGS. 2*a* and 2*b*, the heat exchanger assembly 50 generally comprises a heat exchanger element 52 having a finned inner conduit or pipe 20, sized to receive a fuel filter 54 therein and to fit within an outer oil filter 56, which is in turn enclosed by an oil filter cover 58. The oil filter cover 58 comprises an end flange 57 having several mounting points 59 for engagement with corresponding mounting points 61 on a mating outer assembly housing 60. The heat exchanger element also comprises radially extending flange 55, having a plurality of holes therein. The flange 55 of the heat exchanger element is therefore sandwiched between the flange 57 of the oil filter cover 58 and the mating surface of the outer assembly housing 60. Bolts extending through holes in the mounting points 59 and the holes in the heat exchanger flange 55 can be engaged with the outer assembly housing, thereby retaining the entire assembly together.

Two discrete, concentric fluid passages are thereby provided within the heat exchanger element 52. The central inner passage defined within the inner pipe 20, preferably permitting fuel to flow therethrough, and the outer annular fluid passage defined between the inner pipe 20 and the outer pipe 53 of the heat exchanger element 52, preferably permitting oil flow therethrough. The inner pipe 20 preferably comprises a plurality of heat transfer enhancing fins on both the inner and outer circumferential surfaces thereof, however fins are preferably located on at least the inner circumferential surface of the inner pipe 20.

As described above, pin, or pedestal, fins are difficult to manufacture on a cylindrical heat exchanger tube, particularly on the inner circumferential surface thereof. Longitudinally extending fins can easily be extruded, for example, however pedestal fins are very difficult to efficiently manufacture on the inner surface of a concentric heat exchanger pipe, especially in a manner creating staggered pedestal fins disposed in a relatively dense arrangement.

Figure 3:
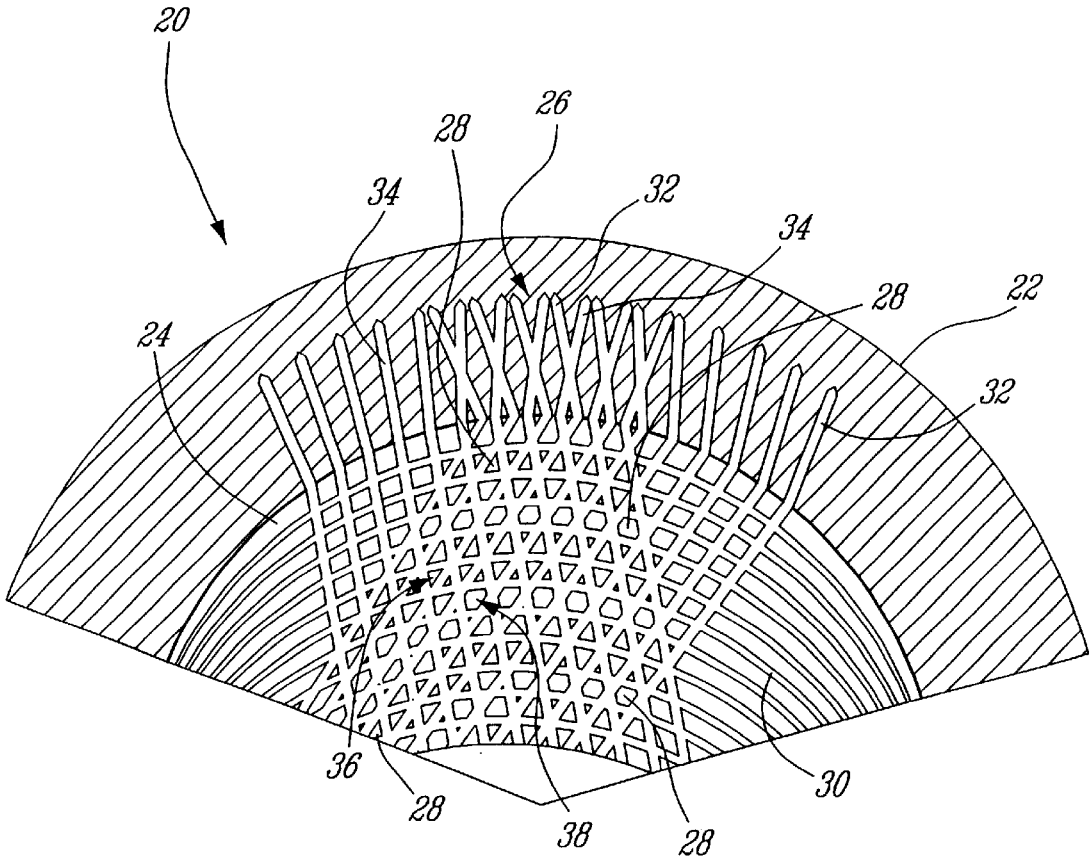
FIG. 3 is a partial perspective view of an inner tube for the cylindrical heat exchanger of FIG. 2*a*, having a plurality of generally staggered pedestal fins on an inner surface thereof.

Referring to FIG. 3, the inner pipe 20 of the heat exchanger element 52 comprises such a dense arrangement of staggered, pedestal-type, heat transfer enhancing fins 28 that can easily be created within the tube 20. The pipe or tube 20 preferably has a sufficient thickness, such that fins of the desired length can be integrally created therefrom. The inner pipe 20 has an outer circumferential surface 22 and an inner circumferential surface 24. A plurality of slots 26 are created in the pipe, preferably in at least the inner circumferential surface 24. The plurality of slots 26 preferably comprise a first set 32 and a second set 34 of longitudinally extending slots disposed at different angles such that the two sets of slots 32,34 intersect each other. A third set of annular slots 30 can also be created within the pipe, intersecting the first and second sets of longitudinal slots 32 and 34. While the described preferred embodiment of the present invention preferably includes three separate sets of slots, it is to be understood that as few as two sets of intersecting slots can be used to create the heat transfer enhancing pedestal fins, and more than three sets of intersecting slots can also be used. Additionally, slots that are non-parallel and intersecting one another, but nevertheless arranged in a criss-crossing manner forming fins therebetween, can similarly be used.

Figure 4A:
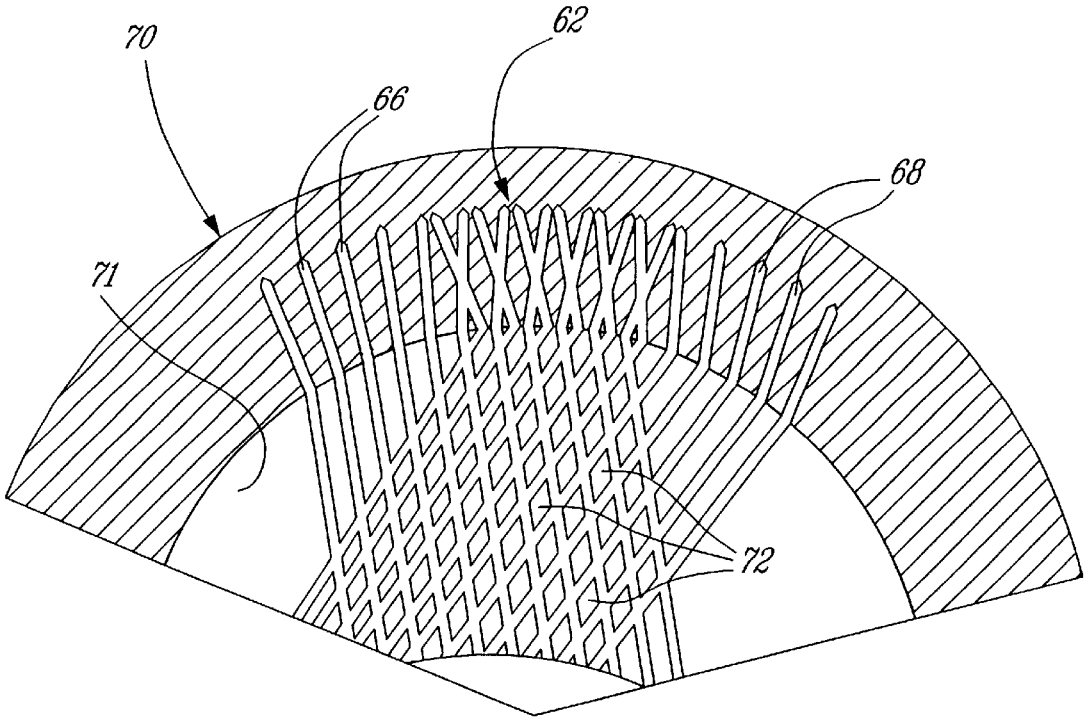
FIG. 4*a* is a partial perspective view of a cylindrical conduit for a heat exchanger of FIG. 2*a*, having an alternate arrangement of slots formed therein.
Figure 4B:
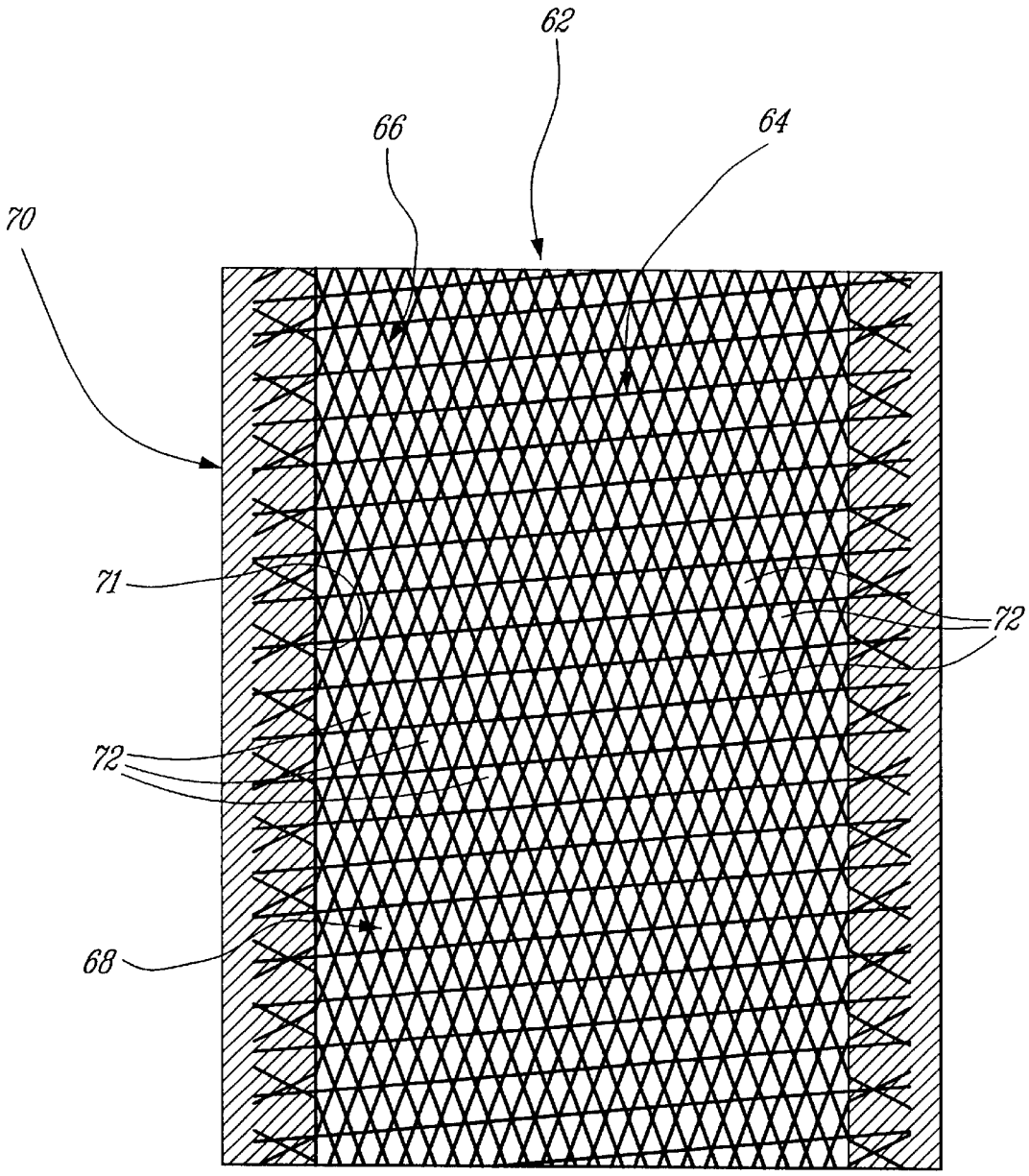
FIG. 4*b* is a longitudinal cross-sectional view of the cylindrical conduit for a heat exchanger of FIG. 2*a*, having another alternate arrangement of slots formed therein.
Figure 4C:
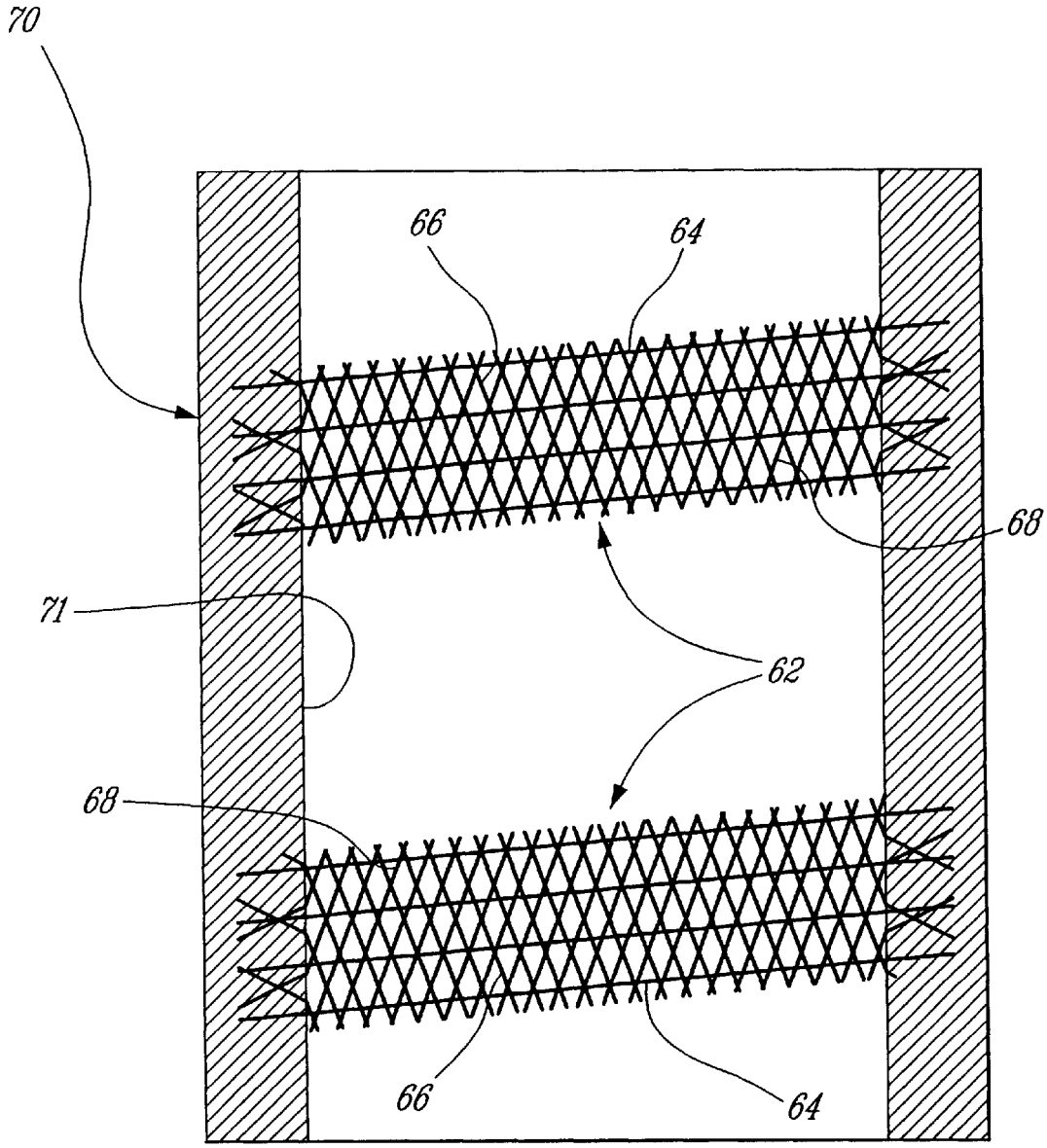
FIG. 4*c* is a longitudinal cross-sectional view of a cylindrical conduit for a heat exchanger of FIG. 2*a*, having a further alternate arrangement of slots formed therein.

Other arrangement of intersecting slots are also possible. For example, in FIG. 4*a*, a cylindrical conduit 70, having an inner wall surface 71, includes a first set of longitudinally extending slots 66 angled in a first direction and a second set of longitudinally extending slots 68 angled in an opposed direction, such that the first and second sets of slots 66 and 68 intersect each other to form a plurality of pedestal type heat transfer enhancing fins 72. The fins 72 thereby form rows of fins that are substantially staggered, such that the rows of fins are offset from upstream and downstream adjacent rows perpendicularly to a direction of fluid flow through the heat exchanger cylindrical conduit 70. Fluid can therefore not flow through the fins 72 without being at least marginally obstructed, increasing flow turbulence and therefore increasing heat transfer. FIGS. 4*b* and 4*c* show a similar but alternate intersecting slot arrangement, wherein the plurality of slots 62 of the cylindrical conduit 70 further comprise at least one helically shaped slot 64 formed throughout the length of the inner surface 71 of the cylindrical conduit 70. The helical slot 64 thereby intersects both the first set of longitudinally extending slots 66 and the second set of longitudinally extending slots 68, forming an alternate arrangement of pedestal type fins 72. In yet a further fin arrangement (not shown), only one of the two sets of longitudinally extending slots 66 or 68 is present, but similarly intersects the helical slot 64. For clarity, the slots are shown in FIG. 4*a* only partially covering the inner surface 71 of the cylindrical conduit 70, however it is to be understood that the full inner surface 71 of the cylindrical conduit 70 preferably comprises the plurality of slots 62. It is, however, also possible to form the plurality of slots 62 only on selected sections of the inner surface 71, as depicted in FIG. 4*c*. Although the embodiment of FIG. 4*c* is shown as a partially slotted version based on the slot arrangement of FIG. 4*b*, it is understood that all slot and fin arrangements disclosed herein can also be formed on all or part of at least the inner surface of the fluid conveying conduit.

Figure 5A:
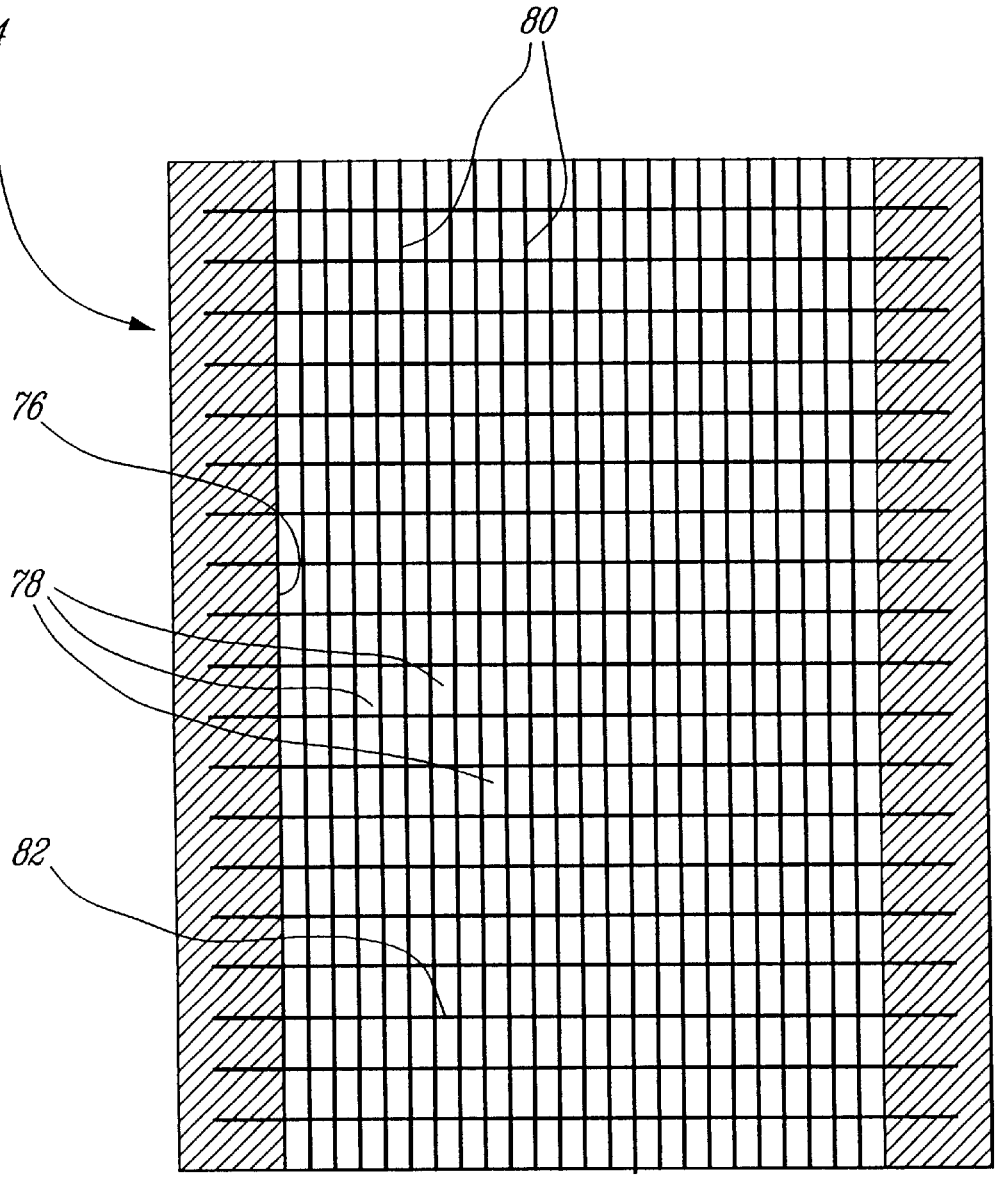
FIG. 5*a* is a longitudinal cross-sectional view of a cylindrical conduit for a heat exchanger of FIG. 2*a*, having a further still alternate arrangement of slots formed therein.
Figure 5B:
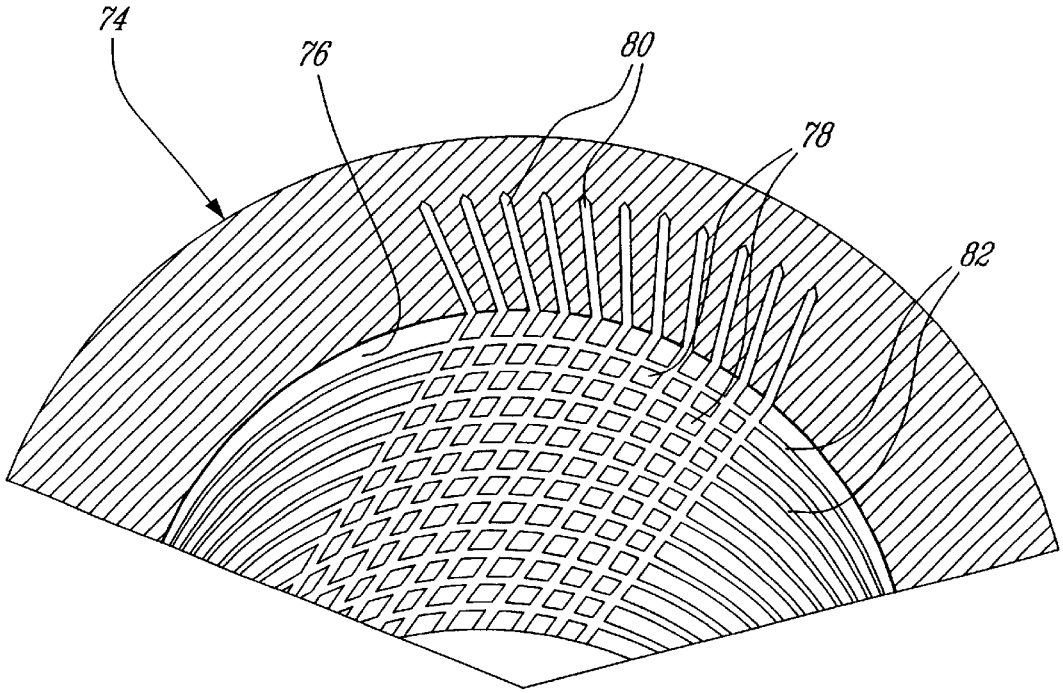
FIG. 5*b* is a partial perspective view of the cylindrical conduit of FIG. 5*a*.

Referring back to FIG. 3, the arrangement of intersecting sets of slots provides the plurality of staggered pedestal fins 28, defined by the material of the pipe left between the plurality of slots. For illustrative purposes, the row 36 of pedestal fins having a substantially triangular cross-sectional area is generally staggered, or perpendicularly offset relative to the direction of flow through the conduit, from the subsequent row of pedestal fins 38. The pedestals fins can also be non-staggered, as shown in FIGS. 5*a* and 5*b*. The non-staggered pedestal fins 78 can be produced by the intersection of two discrete sets of parallel slots intersecting each other, namely longitudinally extending set of slots 80 and circumferential set of slots 82, formed in the inner surface 76 of the conduit 74.

It will be evident to one skilled in the art that the spacing between adjacent slots and the intersection angles between intersecting slots in all embodiments disclosed herein, can be modified in order to vary the number and the specific shape of the pedestal fins created. In this manner, a plurality of pedestal fins having different cross-sectional areas, and being non-uniformly spaced, can be easily created on the inner surface of the heat exchanger pipe by varying the number, spacing, shape, and intersection angles of the slots as desired.

In order to create pedestal fins 28 having predetermined desired dimensions and spacing, which enable the delivery of the desired heat transfer, the plurality of slots 26 must be correctly formed in the heat exchanger pipe. However, relatively dense fins such as those of the preferred embodiment of the present invention, are traditionally difficult to manufacture within the considerably tight confines of a cylindrical conduit, such as the inner pipe 20 of the heat exchanger element 52, using traditional fin production methods. The plurality of slots 26 of the present invention are therefore preferably created using electrical discharge machining.

Electrical discharge machining (EDM) is a well known process. This technique can permit relatively small parts to be machined within confined spaces. A travelling wire electrode, which is used to remove material from a work piece in EDM, can create very small recesses and can fit into spaces too small or inaccessible for standard machine tool cutting bits to fit. As such, EDM easily permits the accurate creation of the plurality of slots 26 in the inner circumferential surface 24 of a heat exchanger pipe 20. EDM particularly also permits the creation of slots to be made in a precise, pre-determined arrangement or layout, as a result of being computer controlled. EDM is therefore preferably used to create the plurality of slots 26 in the inner pipe 20 of the heat exchanger element 52, such that the slots are accurately provided and intersect in a criss-crossing pattern, thereby defining staggered pedestal fins therebetween. Another advantage of using EDM to manufacture the plurality of slots 26, is the fact that EDM can leave a relatively rough surface finish, which further improves the heat transfer capabilities of the heat transfer fins in particular, and heat exchanger as a while in general. EDM is therefore preferably used on the inner or outer surface of the pipe, as a method for creating the plurality of staggered pedestal fins 28, which enhance heat transfer between two fluids discretely flowing on either side of the pipe wall. However, other material removal methods, such as lasers, which would allow the plurality of slots to be formed within the relatively tight confines of the heat exchanger conduits could also be used.

The pedestal fins 28, being preferably staggered, break up boundary layer flow development of the fluids conveyed within the pipes of a compact preferably concentric heat exchanger, thereby improving heat transfer between the fluids and consequently improving the overall performance of the heat exchanger. Such a preferably concentric heat exchanger design permits a performance approximately equivalent to standard plate and fin type heat exchangers to be achieved, while providing significant reductions in size, weight, cost and number of parts over plate heat exchangers.

Figure 6:
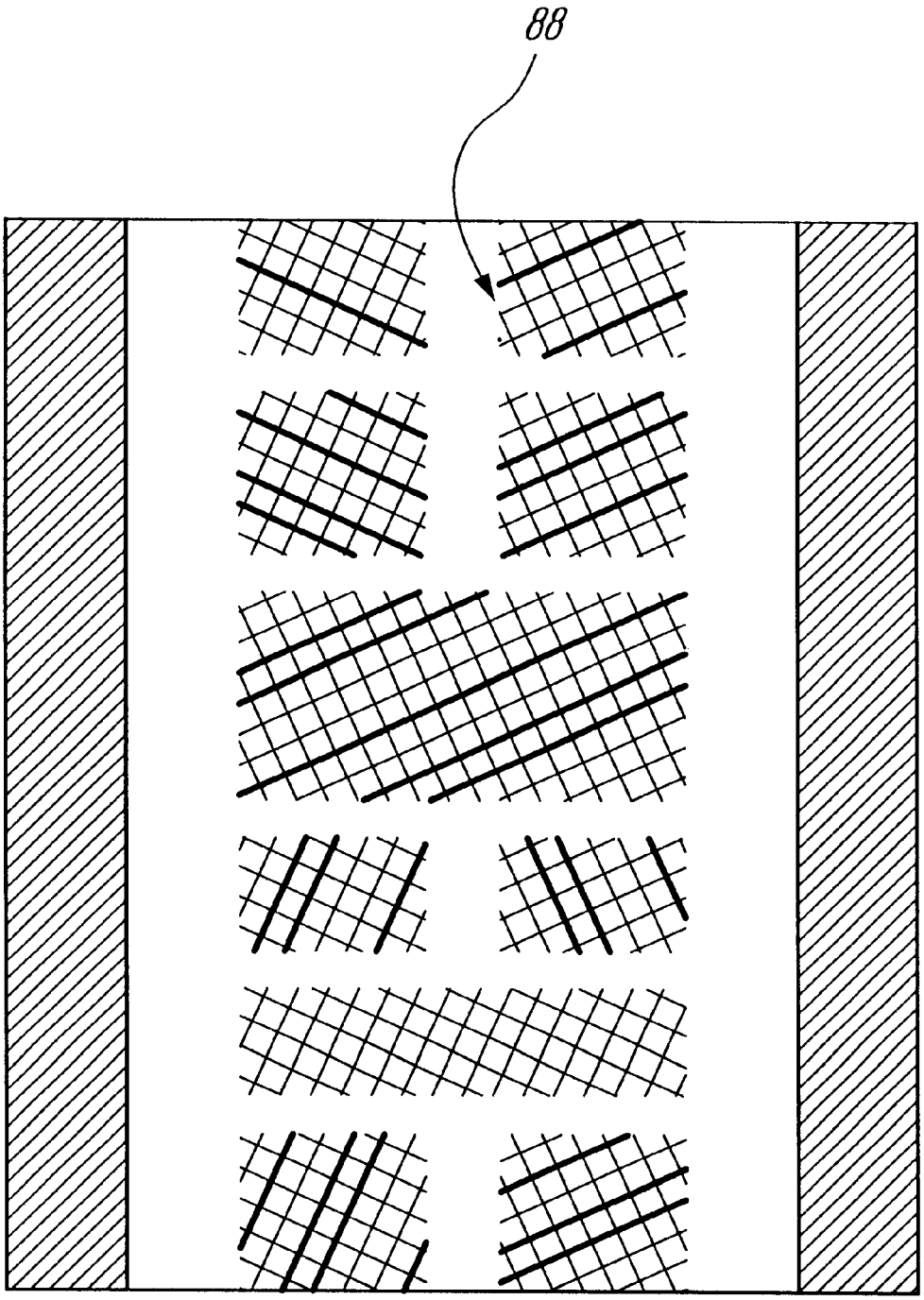
FIG. 6 is a longitudinal cross-sectional view of a cylindrical conduit for a heat exchanger of FIG. 2*a*, having another alternate arrangement of slots formed therein.

While the plurality of slots preferably comprise at least two sets of intersecting slots, each set being comprised of parallel individual slots, it is understood that the plurality of slots can be non-uniformly arranged or sized, as per the plurality of slots 88 in FIG. 6, such that the particular arrangement and distribution of the pedestal fins formed therebetween can be designed to provide the selected heat transfer given the particular application, fluid type and materials used. As EDM is conducted from a computer program, these variables of pedestal fin creation can be easily controlled to provide a cylindrical heat exchanger pipe having the heat transfer characteristics desired. No matter the slot arrangement chosen, the plurality of intersecting slots preferably arranged in a generally criss-crossing pattern form the pedestal fins 28 having desired dimensions and spacing, which enable the delivery of the desired heat transfer.

Significant advantages exist when a heat exchanger assembly according to the present invention is used in a gas turbine engine as a fuel-oil heat exchanger. The relatively low number of parts of the present preferably concentric, cylindrical heat exchanger, corresponds to a low weight and a relatively low cost with respect to conventional plate-type fuel-oil heat exchangers. Additionally, as the electrical discharge machining of the plurality of slots 26 permits dense staggered pedestal fins 28 to be provided on the inner pipe 20 of the heat exchanger, particularly on the inner fuel side thereof, the performance of the present concentric heat exchanger is at least equivalent to conventional plate-type heat exchangers, while being more compact, lightweight and much less costly.

While what is disclosed is the preferred embodiments, one skilled in the art will recognize that certain changes may be made without departing from the scope of the present invention, as defined by the appended claims. For example, the conduits need not be cylindrical nor concentric. The fluids need not be liquids, and the criss-crossing pattern need not cover the entire heat exchanger surface. Still other modifications, variations and alternatives will be apparent to those skilled in the art. Accordingly it is intended that such modifications, variations, and alternatives be within the spirit and scope of the appended claims.

What is claimed is:

1. A heat exchanger permitting heat transfer between a first and a second fluid conveyed therethrough, comprising:

an inner conduit and an outer conduit, the inner conduit defining a first passage for conveying the first fluid therethrough, the inner conduit being inside the outer conduit, and the inner conduit and the outer conduit defining a second passage therebetween for conveying the second fluid therethrough; and at least the inner conduit having a plurality of slots in at least an inner surface thereof, the plurality of slots being provided at least partially in a criss-crossing arrangement, thereby defining a plurality of heat transfer fins on at least the inner surface of the inner conduit.

2. The heat exchanger as defined in claim 1, wherein the inner conduit and the outer conduit are cylindrical pipes.

3. The heat exchanger as defined in claim 1, wherein the heat exchanger is a fuel-oil heat exchanger for a gas turbine engine.

4. The heat exchanger as defined in claim 1, wherein the plurality of heat transfer fins are pedestal fins.

5. The heat exchanger as defined in claim 1, wherein the plurality of heat transfer fins form rows that are staggered, the rows of fins being offset from upstream and downstream adjacent rows substantially perpendicularly to a direction of fluid flow through the heat exchanger, such that fluid can not flow through the heat transfer fins without being at least marginally obstructed.

6. The heat exchanger as defined in claim 1, wherein the plurality of slots comprise a first set of slots parallel to one another, and a second set of slots parallel to one another, the first and second sets of slots intersecting one another in the criss-crossing arrangement in at least a portion of the heat exchanger.

7. The heat exchanger as defined in claim 6, wherein the plurality of slots comprise a third set of slots parallel to one another, the third set of slots intersecting both the first and second sets of slots.

8. The heat transfer as defined in claim 6, wherein the plurality of slots are uniformly spaced.

9. The heat exchanger as defined in claim 1, wherein the inner conduit and the outer conduit are coaxial.

10. The heat exchanger as defined in claim 1, wherein the plurality of slots are also provided in an outer surface of the inner conduit.

11. A heat exchanger permitting heat transfer between a first and a second fluid conveyed therethrough, comprising:

a first conduit and a second conduit, the first conduit being adapted for conveying the first fluid therein and the second conduit being adapted for conveying the second fluid therein;

the first conduit and the second conduit being relatively arranged such that heat transfer between the first fluid and second fluid is permitted; and at least one of the first conduit and the second conduit having a plurality of slots in an inner surface thereof, the plurality of slots being disposed in a criss-crossing arrangement such a plurality of heat transfer enhancing fins are provided therebetween.

12. The heat exchanger as defined in claim 11, wherein the heat exchanger is a cylindrical heat exchanger.

13. The heat exchanger as defined in claim 12, wherein the cylindrical heat exchanger is a fuel-oil heat exchanger for a gas turbine engine.

14. The heat exchanger as defined in claim 12, wherein the first conduit and the second conduit are coaxial pipes.

15. The heat exchanger as defined in claim 11, wherein the first conduit and the second conduit have a common wall, the common wall having the plurality of slots disposed therein.

16. The heat exchanger as defined in claim 11, wherein the plurality of heat transfer enhancing fins form rows that are staggered, the rows of fins being offset from upstream and downstream adjacent rows substantially perpendicularly to a direction of fluid flow through the heat exchanger, such that fluid can not flow through the heat transfer fins without being at least marginally obstructed.

17. The heat exchanger as defined in claim 1, wherein the plurality of heat transfer enhancing fins are pedestal fins.

* * * * *

UNITED STATES PATENT AND TRADEMARK OFFICE

CERTIFICATE OF CORRECTION

PATENT NO. : 6,675,881 B1
DATED : January 13, 2004
INVENTOR(S) : Rago, G

It is certified that error appears in the above-identified patent and that said Letters Patent is hereby corrected as shown below:

Title page,
Item [75], Inventor, should read as follows:
-- Giuseppe Rago --

Signed and Sealed this

Eleventh Day of May, 2004

JON W. DUDAS
*Acting Director of the United States Patent and Trademark Office*